US008793912B1

(12) United States Patent
Gunther

(10) Patent No.: US 8,793,912 B1
(45) **Date of Patent: *Aug. 5, 2014**

(54) GREETING CARD DISPLAY SYSTEM

(71) Applicant: Julie Gunther, Tucson, AZ (US)
(72) Inventor: Julie Gunther, Tucson, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/082,632
(22) Filed: Nov. 18, 2013

Related U.S. Application Data

(63) Continuation-in-part of application No. 13/685,925, filed on Nov. 27, 2012, now Pat. No. 8,613,155, which is a continuation-in-part of application No. 12/711,552, filed on Feb. 24, 2010, now Pat. No. 8,341,862.
(60) Provisional application No. 61/156,415, filed on Feb. 27, 2009.

(51) Int. Cl.

| | |
|---|---|
| ***G09F 3/18*** | (2006.01) |
| ***A47G 1/06*** | (2006.01) |
| ***G09F 3/10*** | (2006.01) |
| ***G09D 3/02*** | (2006.01) |
| ***G09F 1/00*** | (2006.01) |

(52) U.S. Cl.
USPC ..... 40/661; 40/702; 40/701; 40/703; 40/773; 40/722; 40/774; 40/673; 40/672; 40/122; 40/776; 40/594; 40/124.06; 206/449; 206/308.1; 229/72; 229/67.1; 229/67.4

(58) Field of Classification Search
USPC ..... 40/701–703, 773, 722, 774, 661, 673, 40/672, 122, 776, 594, 124.06; 206/459, 206/308.1; 229/72, 67.1, 67.4
See application file for complete search history.

(56) References Cited

U.S. PATENT DOCUMENTS

| | | | | |
|---|---|---|---|---|
| 253,356 | A * | 2/1882 | Edmondson | 229/72 |
| 2,718,911 | A | 9/1955 | Solomon | |
| 2,925,675 | A | 2/1960 | Lumpkin | |
| 3,696,532 | A * | 10/1972 | Nahon | 40/661 |
| 4,620,630 | A * | 11/1986 | Moss | 206/45.24 |
| 5,873,513 | A | 2/1999 | Ong | |
| 6,390,714 | B1 | 5/2002 | Bradley et al. | |
| 7,418,796 | B2 * | 9/2008 | Anastasio | 40/735 |
| 8,341,862 | B1 | 1/2013 | Gunther | |
| 2005/0198882 | A1 | 9/2005 | Zaremba | |
| 2006/0162213 | A1 | 7/2006 | Einarson | |
| 2008/0115396 | A1 | 5/2008 | Gamboa | |

* cited by examiner

*Primary Examiner* — Syed A Islam

(57) ABSTRACT

A greeting card display system features a greeting card with a card first panel and a card second panel pivotally attached. A first crease divides a card front surface from a card back surface and a card first inside surface from a card second inside surface. The system features a protective sleeve with a sleeve first panel and a sleeve second panel. The protective sleeve features a sleeve cavity with a single sleeve opening adapted for insertion of the greeting card. The sleeve first panel is pivotally located on the sleeve second panel via a sleeve first outside crease that divides the front surface from the back surface and a sleeve first inside crease that divides the first inside surface from the second inside surface.

17 Claims, 9 Drawing Sheets

GREETING CARD DISPLAY SYSTEM

CROSS REFERENCE

This application claims priority to and is a continuation-in-part of U.S. Non-Provisional application Ser. No. 13/685,925 filed Nov. 27, 2012 and U.S. Non-Provisional application Ser. No. 12/711,552 filed Feb. 24, 2010, now U.S. Pat. No. 8,341,862, and claims priority to U.S. Provisional Application No. 61/156,415 filed Feb. 27, 2009, the specifications of which are incorporated herein by reference in their entirety.

FIELD OF THE INVENTION

The present invention relates to greeting card display systems.

BACKGROUND OF THE INVENTION

The custom of sending greeting cards can be traced back to ancient Chinese and Egyptian civilizations. By the 15th century, Europeans were printing New Year's greetings and with the continued advances in printing, the custom continued to gain in popularity. The first Christmas card was believed to have appeared in 1843 with mass production of greeting cards following shortly thereafter.

Often a receiver of a greeting card may wish to save, preserve or even display the greeting card in various manners. Some may wish to prop the greeting card up on a table, a desk, or a mantle, while others may store the greeting card in a box or photo album. The present invention features a greeting card display system that provides an aesthetically pleasing means of displaying greeting cards.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a greeting card display system. In some embodiments, the system comprises a greeting card having at least a card first panel and a card second panel. In some embodiments, the greeting card comprises a card front surface, a card back surface, a card first inside surface, and a card second inside surface. In some embodiments, the greeting card comprises a card top edge, a card bottom edge, a card first edge, a card second edge, and a card first crease from the card top edge to the card bottom edge.

In some embodiments, the card first panel is pivotally attached to the card second panel via the first crease. In some embodiments, the first crease divides the card front surface from the card back surface and the card first inside surface from the card second inside surface. In some embodiments, in a first open position, the card first inside surface is pivoted away from the card second inside surface. In some embodiments, in a second closed position, the card first inside surface is pivoted against the card second inside surface.

In some embodiments, the system comprises a protective sleeve having at least a sleeve first panel and a sleeve second panel. In some embodiments, the protective sleeve comprises a sleeve front surface, a sleeve back surface, a sleeve first inside surface, and a sleeve second inside surface. In some embodiments, the protective sleeve comprises a sleeve top edge, a sleeve bottom edge, a sleeve first edge, a sleeve second edge, and sleeve first inside and outside creases from the sleeve top edge to the sleeve bottom edge. In some embodiments, the protective sleeve comprises a sleeve cavity located therein from the sleeve top edge to the sleeve bottom edge and the sleeve first edge to the sleeve second edge. In some embodiments, the protective sleeve comprises a single sleeve opening fluidly connected to the sleeve cavity located on the sleeve top edge, the sleeve bottom edge, the sleeve first edge, or the sleeve second edge. In some embodiments, the single sleeve opening is adapted for insertion of the greeting card.

In some embodiments, the protective sleeve comprises at least three sealed edges located on any combination of the sleeve top edge, the sleeve bottom edge, the sleeve first edge, or the sleeve second edge. In some embodiments, the sleeve first panel is pivotally located on the sleeve second panel via the sleeve first inside crease and the sleeve first outside crease. In some embodiments, the sleeve first outside crease divides the front surface from the back surface and the sleeve first inside crease divides the first inside surface from the second inside surface. In some embodiments, the sleeve first inside crease and the first outside crease each lay on a plane, Plane A.

In some embodiments, in a first open position, the sleeve first inside surface is pivoted away from the sleeve second inside surface. In some embodiments, in a second closed position, the sleeve first inside surface is pivoted against the sleeve second inside surface. In some embodiments, in the first open position and the second dosed position, the sleeve first inside crease and the sleeve first outside crease each lay on Plane A. In some embodiments, the protective sleeve comprises a general shape of an envelope.

In some embodiments, the sleeve front surface, the sleeve first inside surface, and the sleeve second inside surface are transparent, semi-transparent or translucent. In some embodiments, the protective sleeve comprises a first attaching means located on a sleeve back surface thereon.

In some embodiments, the protective sleeve is moved into a first open position. In some embodiments, the greeting card is inserted into the sleeve cavity of the protective sleeve via the sleeve opening. In some embodiments, the protective sleeve is moved into a second closed position.

DESCRIPTION OF PREFERRED EMBODIMENTS

Following is a list of elements corresponding to a particular element referred to herein:

100 Greeting card display system
200 Greeting card
210 Card first panel
220 Card second panel
230 Card front surface

Figure 1:
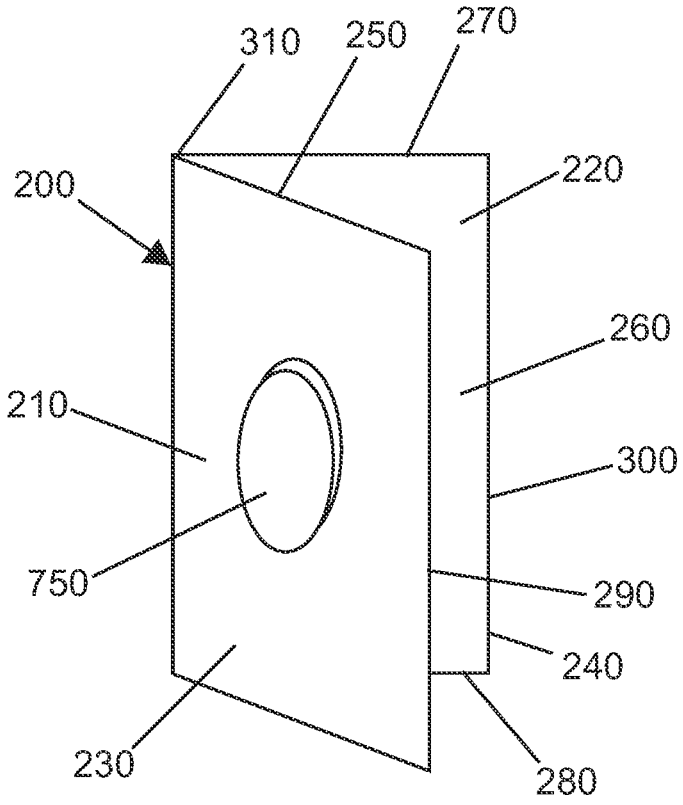
FIG. 1 is a perspective view of the greeting card of the present invention.
Figure 2:
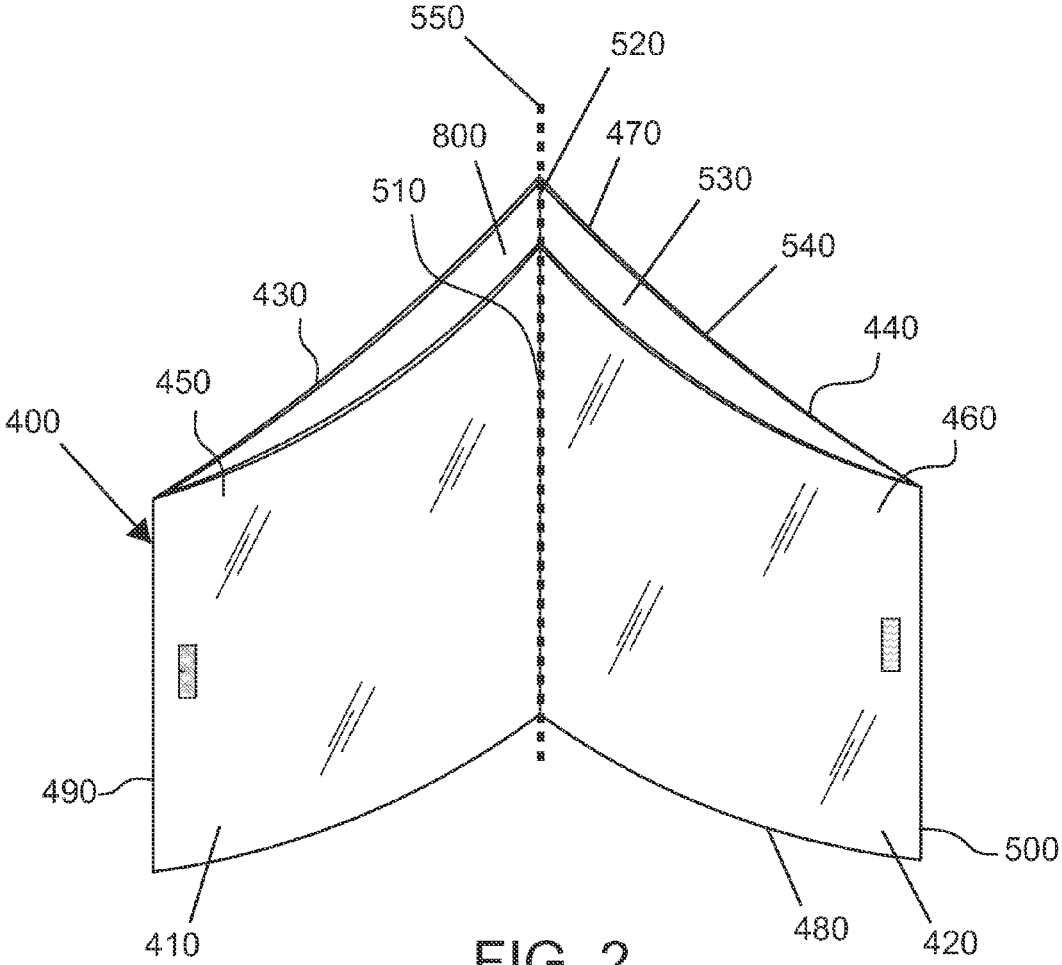
FIG. 2 is a perspective view of the protective sleeve of the present invention.
Figure 3:
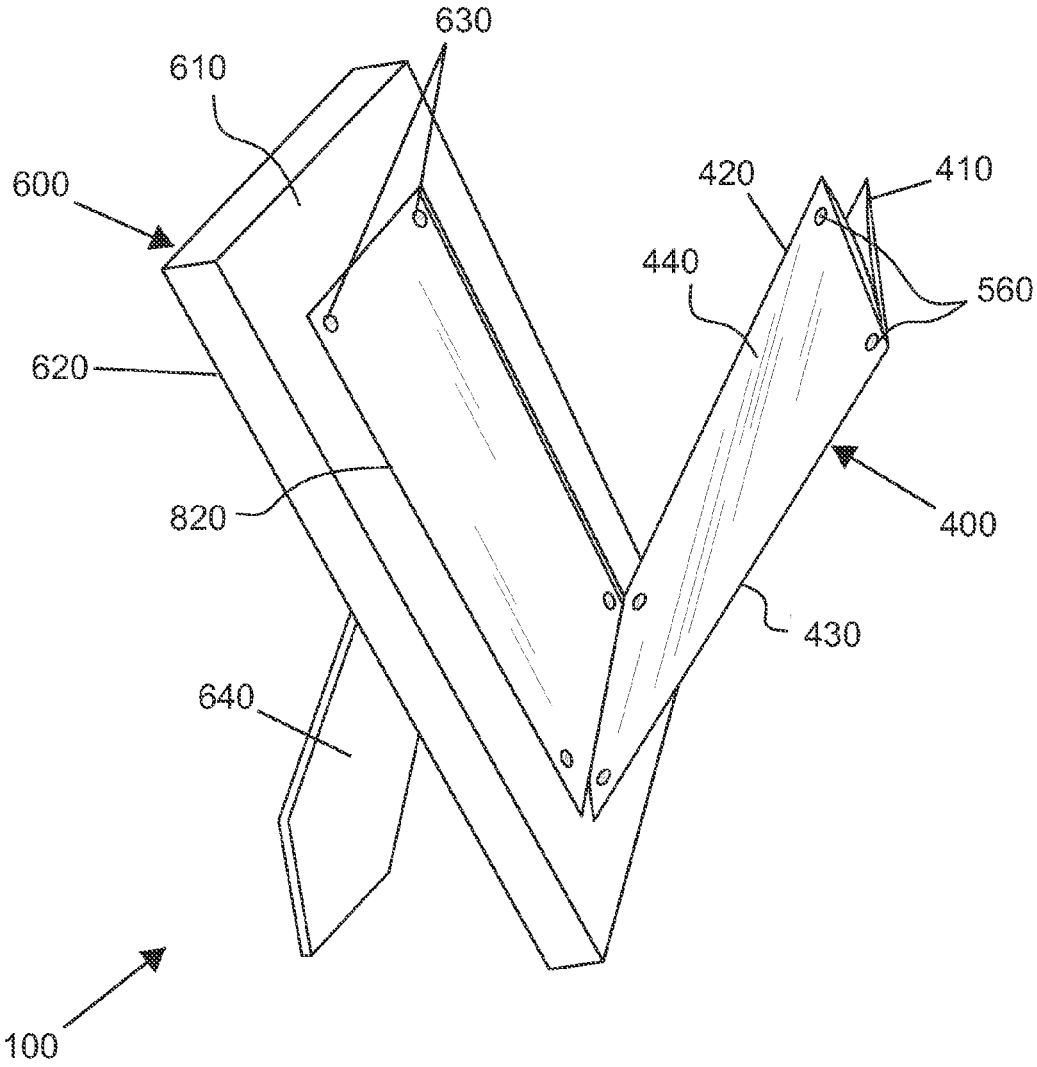
FIG. 3 is a perspective view of the present invention.
Figure 4:
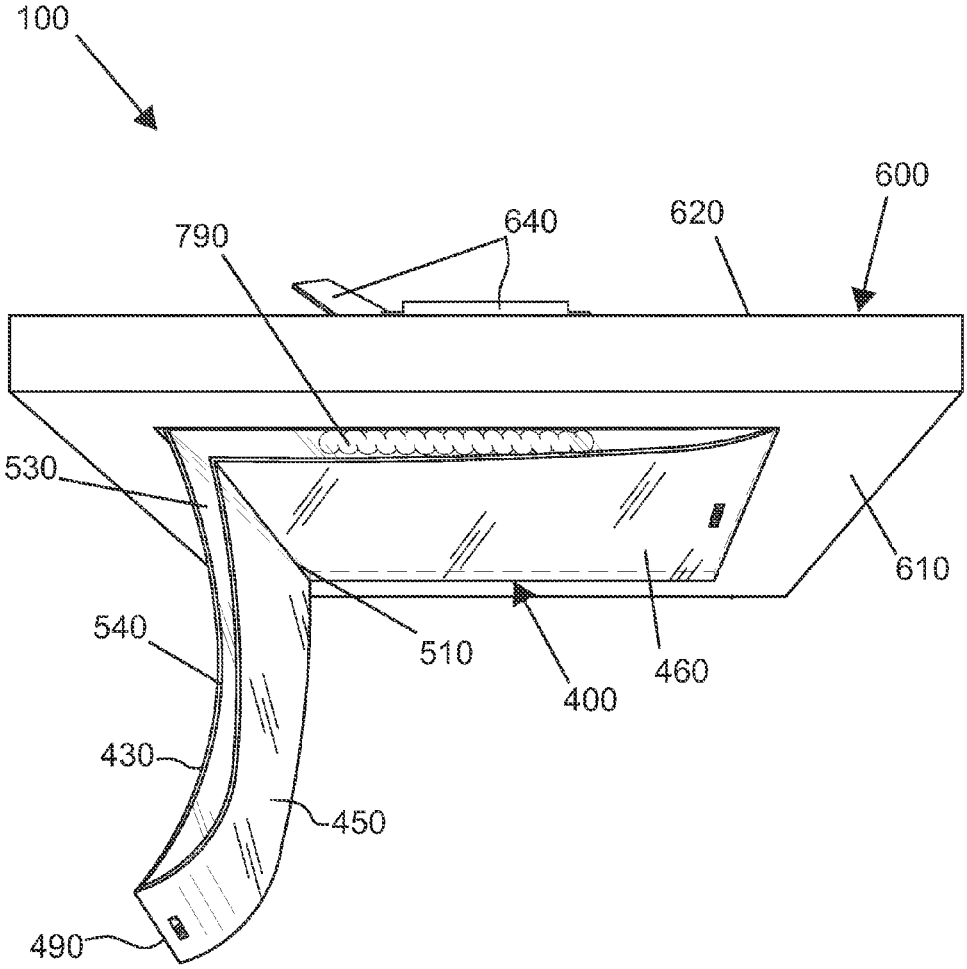
FIG. 4 is a top view of the present invention.
Figure 5:
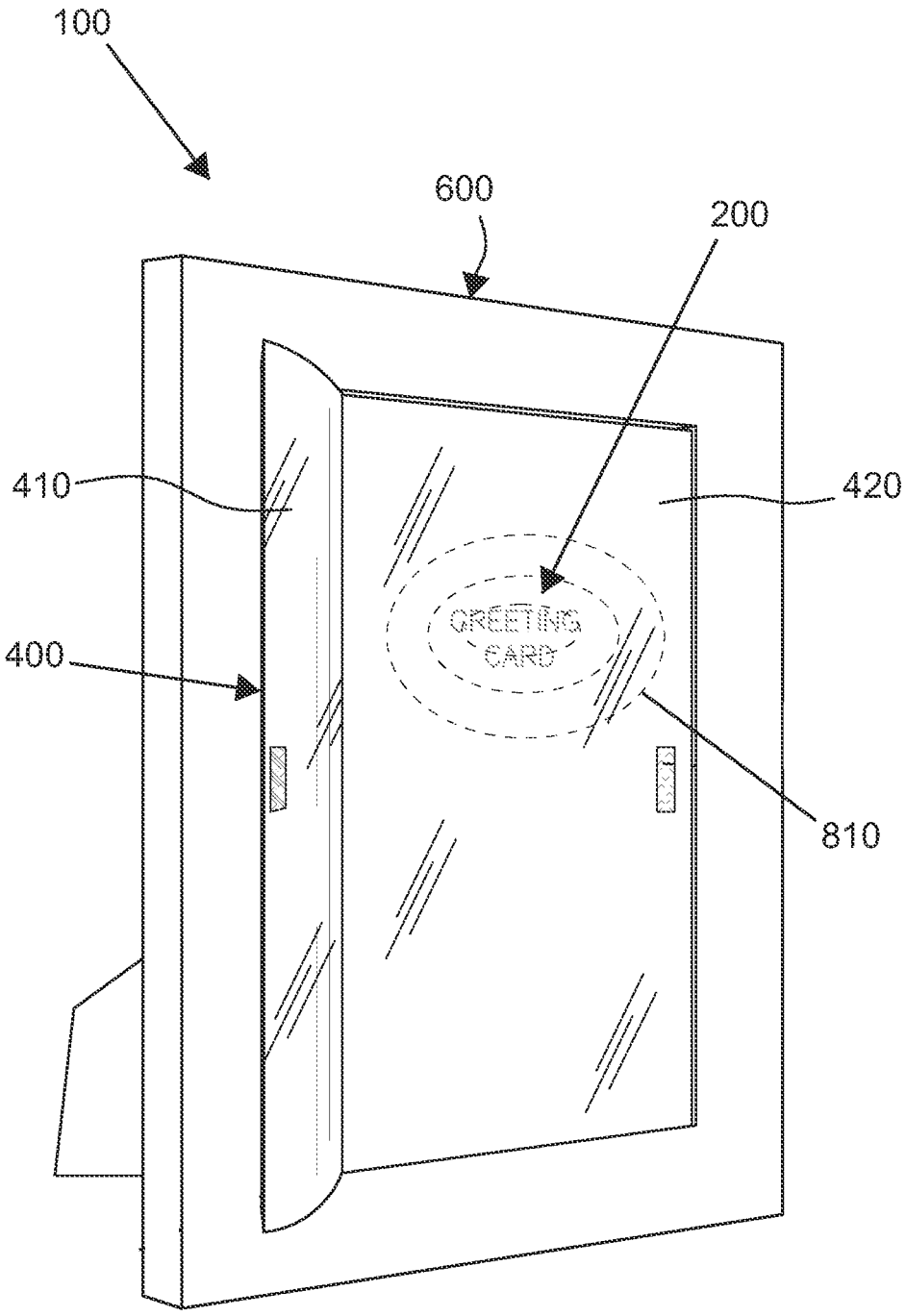
FIG. 5 is a front view of the present invention.
Figure 6:
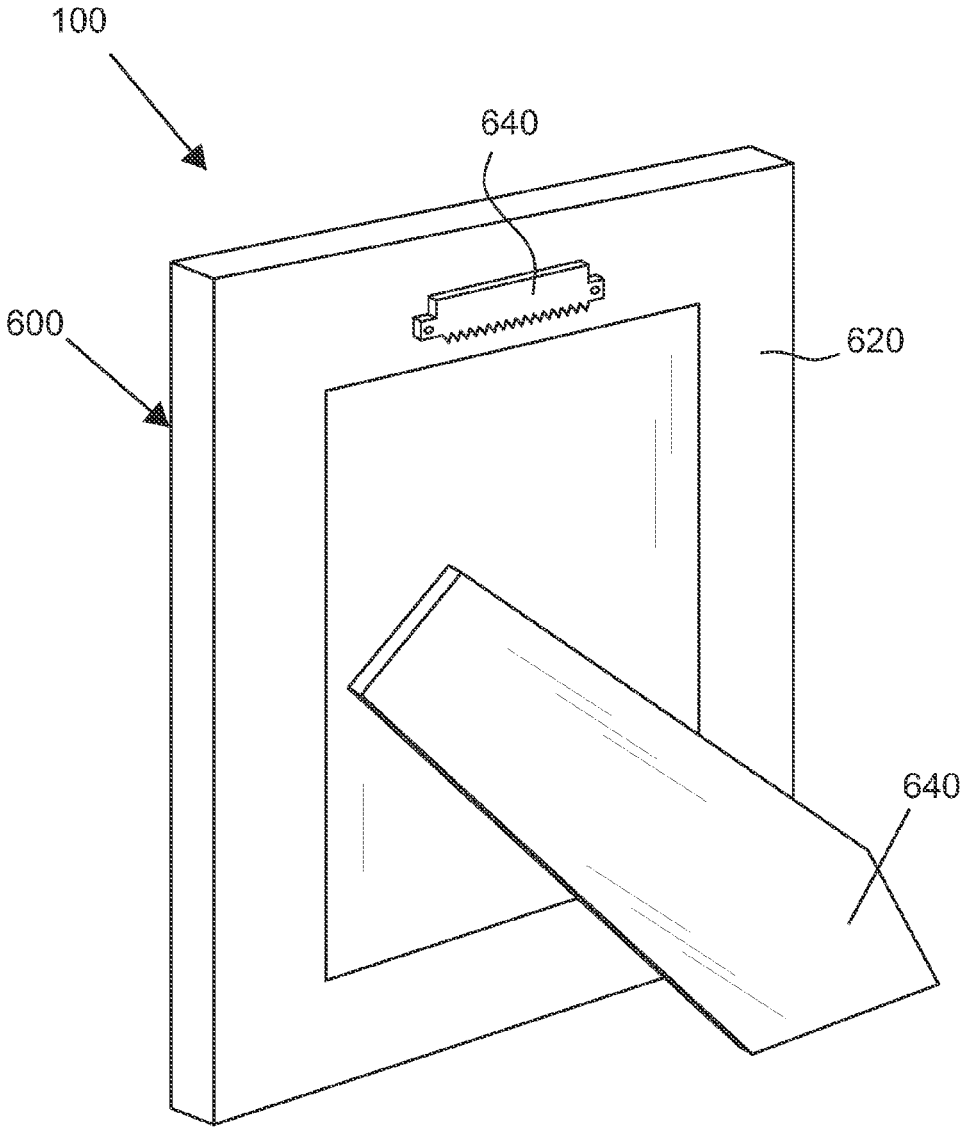
FIG. 6 is a rear view of the present invention.
Figure 7:
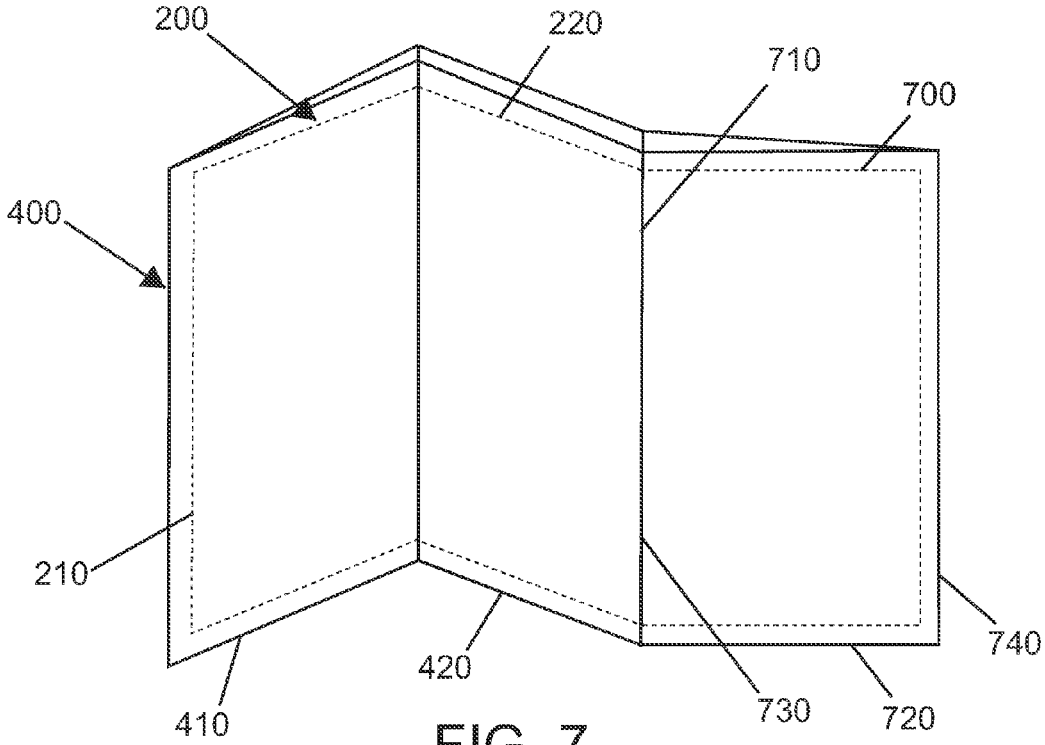
FIG. 7 is a perspective view of an alternate embodiment of the greeting card and the protective sleeve of the present invention.
Figure 8:
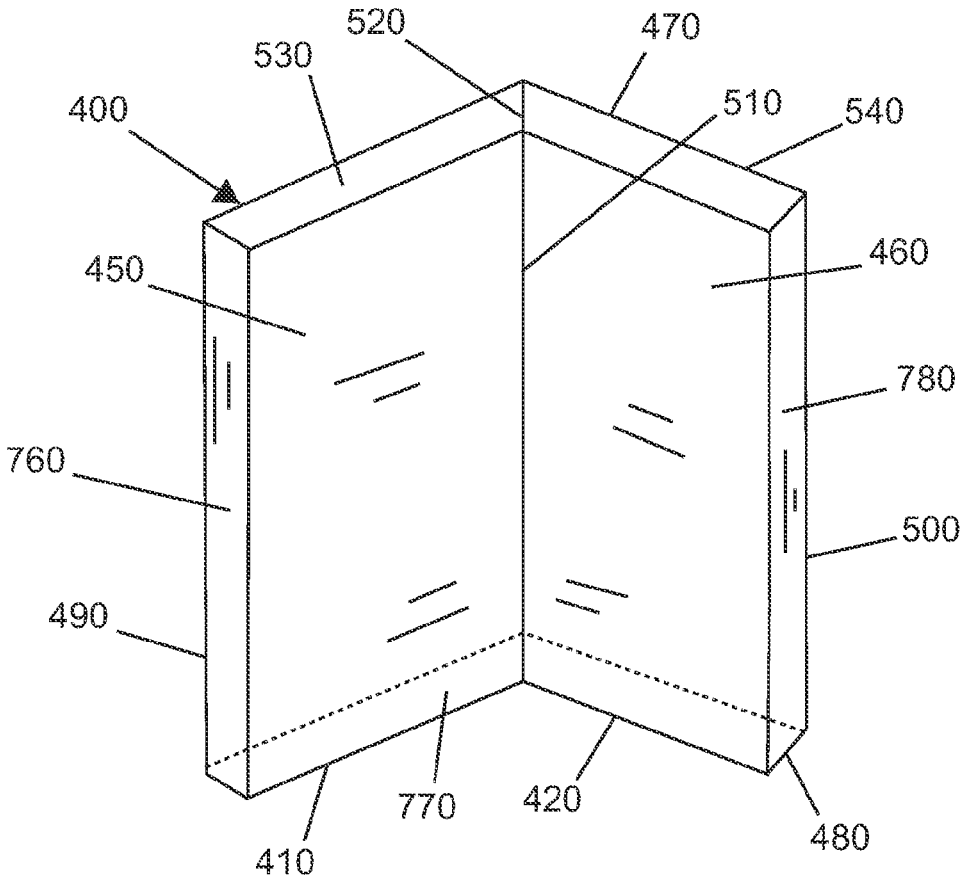
FIG. 8 is a front view of an alternate embodiment of the protective sleeve of the present invention.
Figure 9:
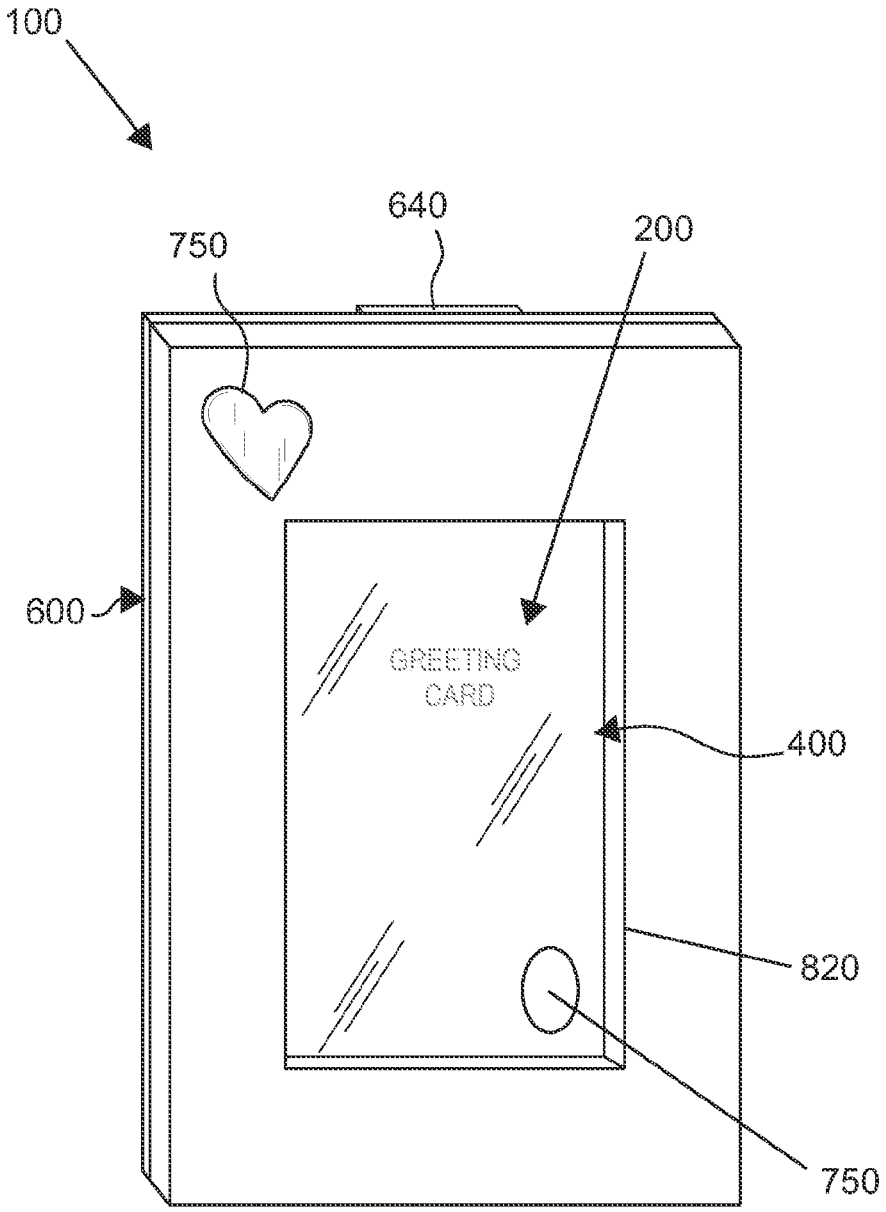
FIG. 9 is a front view of an alternate embodiment of the present invention.

240 Card back surface
250 Card first inside surface
260 Card second inside surface
270 Card top edge
280 Card bottom edge
290 Card first edge
300 Card second edge
310 Card first crease
400 Protective sleeve
410 Sleeve first panel
420 Sleeve second panel
430 Sleeve front surface
440 Sleeve back surface
450 Sleeve first inside surface
460 Sleeve second inside surface
470 Sleeve top edge
480 Sleeve bottom edge
490 Sleeve first edge
500 Sleeve second edge
510 Sleeve first inside crease
520 Sleeve first outside crease
530 Sleeve cavity
540 Sleeve opening
550 Plane A
560 First attaching means
600 Display unit
610 Display unit front surface
620 Display unit back surface
630 Second attaching means
640 Display unit mounting component
700 Card third panel
710 Card third panel first edge
720 Sleeve third panel
730 Sleeve third panel first inside edge
740 Sleeve third panel first outside edge
750 Decorative component
760 Sleeve first edge panel
770 Sleeve second edge panel
780 Sleeve third edge panel
790 Sealing means
800 Sleeve cavity inside surface
810 Magnification component
820 Recess Referring now to FIG. 1-9, the present invention features a greeting card display system (100) for preserving and displaying a greeting card (200). In some embodiments, said system (100) comprises a greeting card (200) having at least a card first panel (210) and a card second panel (220). In some embodiments, the greeting card (200) comprises a card front surface (230) located on a card first panel (210), a card back surface (240) located on a card second panel (220), a card first inside surface (250) located on the card first panel (210) opposed to the card front surface (230), a card second inside surface (260) located on the card second panel (220) opposed to the card back surface (240), a card top edge (270) located on the card first panel (210) and the card second panel (220), a card bottom edge (280) located on the card first panel (210) and the card second panel (220) opposed to the card top edge (270), a card first edge (290) located on the card first panel (210), a card second edge (300) located on the card second panel (220), and a card first crease (310) located from the card top edge (270) to the card bottom edge (280). In some embodiments, the card first panel (210) is pivotally located on the card second panel (220) via the card first crease (310). In some embodiments, the card first crease (310) divides the card front surface (230) from the card back surface (240) and the card first inside surface (250) from the card second inside surface (260). In some embodiments, in a first open position, the card first inside surface (250) is pivoted away from the card second inside surface (260). In some embodiments, in a second closed position, the card first inside surface (250) is pivoted interfacingly against the card second inside surface (260).

In some embodiments, the system (100) comprises a protective sleeve (400) having at least a sleeve first panel (410) and a sleeve second panel (420). In some embodiments, the protective sleeve (400) comprises a sleeve front surface (430) located on a sleeve first panel (410), a sleeve back surface (440) located on a sleeve second panel (420), a sleeve first inside surface (450) located on the sleeve first panel (410) opposed to the sleeve front surface (430), a sleeve second inside surface (460) located on the sleeve second panel (420) opposed to the sleeve back surface (440), a sleeve top edge (470) located on the sleeve first panel (410) and the sleeve second panel (420), a sleeve bottom edge (480) located on the sleeve first panel (410) and the sleeve second panel (420) opposed to the sleeve top edge (470), a sleeve first edge (490) located on the sleeve first panel (410), a sleeve second edge (500) located on the sleeve second panel (420), a sleeve first inside crease (510) located from the sleeve top edge (470) to the sleeve bottom edge (480), and a sleeve first outside crease (520) located from the sleeve top edge (470) to the sleeve bottom edge (480). In some embodiments, the protective sleeve (400) comprises a sleeve cavity (530) located therein from the sleeve top edge (470) to the sleeve bottom edge (480) and the sleeve first edge (490) to the sleeve second edge (500). In some embodiments, the sleeve cavity (530) passes through and is not divided by the sleeve first inside crease (510) and the sleeve first outside crease (520). In some embodiments, the protective sleeve (400) comprises a single sleeve opening (540) fluidly connected to the sleeve cavity (530) located on the sleeve top edge (470), the sleeve bottom edge (480), the sleeve first edge (490), or the sleeve second edge (500). In some embodiments, the single sleeve opening (540) is adapted for insertion of the greeting card (200).

In some embodiments, the protective sleeve (400) comprises at least three sealed edges located on any combination of the sleeve top edge (470), the sleeve bottom edge (480), the sleeve first edge (490), or the sleeve second edge (500). In some embodiments, the sleeve first panel (410) is pivotally located on the sleeve second panel (420) via the sleeve first inside crease (510) and the sleeve first outside crease (520). In some embodiments, the sleeve first outside crease (520) divides the sleeve front surface (430) from the sleeve back surface (440) and the sleeve first inside crease (510) divides the sleeve first inside surface (450) from the sleeve second inside surface (460). In some embodiments, the sleeve first inside crease (510) and the sleeve first outside crease (520) each lay on a plane, Plane A (550). In some embodiments, in a first open position, the sleeve first inside surface (450) is pivoted away from the sleeve second inside surface (460). In some embodiments, in a second closed position, the sleeve first inside surface (450) is pivoted interfacingly against the sleeve second inside surface (460). In some embodiments, the protective sleeve (400) comprise a general shape of an envelope. In some embodiments, the sleeve front surface (430), the sleeve first inside surface (450), and the sleeve second inside surface (460) are transparent, semi-transparent or translucent. In some embodiments, the sleeve back surface (440) comprises a first attaching means (560).

In some embodiments, the protective sleeve (400) is moved into the first open position. In some embodiments, the greeting card (200) is inserted into the sleeve cavity (530) of the protective sleeve (400) via the sleeve opening (540). In some embodiments, the protective sleeve (400) is moved into the second dosed position. In some embodiments, the protective sleeve (400) is designed to be located on a display unit (600) via the first attaching means (560).

In some embodiments, the system (100) further comprises the display unit (600) having a display unit front surface (610) and a display unit back surface (620). In some embodiments, the display unit front surface (610) is adapted to receive the protective sleeve (400) located thereon via a second attaching means (630). In some embodiments, the second attaching means (630) adapted to connectably receive the first attaching means (560). In some embodiments, the display unit back surface (620) comprises a display unit mounting component (640) located thereon.

In some embodiments, the greeting card (200) comprises a card third panel (700) having a card third panel first edge (710) pivotally located on the card second edge (300). In some embodiments, the protective sleeve (400) comprises a sleeve third panel (720) having a sleeve third panel first inside edge (730) pivotally located on the sleeve front surface of the sleeve second edge (500) and the sleeve third panel first outside edge (740) pivotally located on the sleeve back surface of the sleeve second edge (500).

In some embodiments, the card first panel (210) comprises a decorative component (750) located thereon having a thickness. In some embodiments, the card first panel (210) comprises a thickness between 0 inches and ½ inches at a thickest point between the card front surface (230) having the decorative component (750) located thereon and the card first Inside surface (250). In some embodiments, the protective sleeve (400) comprises a sleeve first edge panel (760), a sleeve second edge panel (770) and a sleeve third edge panel (780). In some embodiments, the sleeve first edge panel (760), a sleeve second edge panel (770) and a sleeve third edge panel (780) each comprise a width adapted to accommodate the first panel comprising a decorating component located thereon. In some embodiments, the sleeve first edge panel (760) is located at the sleeve first edge (490) having edges fluidly connecting the sleeve front surface (430) to the sleeve back surface (440). In some embodiments, the sleeve second edge panel (770) is located at the sleeve bottom edge (480) or the sleeve top edge (470) having edges fluidly connecting the sleeve front surface (430) to the sleeve back surface (440). In some embodiments, the sleeve third edge panel (780) is located at the sleeve second edge (500) having edges fluidly connecting the sleeve front surface (430) to the sleeve back surface (440).

In some embodiments, the single sleeve opening (540) comprises a sealing means (790) located thereon. In some embodiments, the sealing means (790) is reopenable and resealable.

In some embodiments, a sleeve cavity inside surface (800) comprises a non-stick coating located thereon.

In some embodiments, the protective sleeve (400) comprises a decorative component (750) located on a sleeve front surface (430) thereon.

In some embodiments, the sleeve first panel (410) and the sleeve second panel (420) are bendable and are constructed from a bendable material. In some embodiments, the sleeve first panel (410) and the sleeve second panel (420) are rigid and are constructed from a rigid material.

In some embodiments, the protective sleeve (400) is constructed from a material that comprises an ultra-violet radiation protection component.

In some embodiments, the protective sleeve (400) is constructed from a material that is polarized.

In some embodiments, the protective sleeve (400) comprises a magnification component (810) located on a sleeve front surface (430), a sleeve first inside surface (450), a sleeve second inside surface (460), or any combination thereof.

In some embodiments, the sleeve first edge (490), the sleeve second edge (500), and the sleeve bottom edge (480) are sealed.

In some embodiments, the sleeve top edge (470), the sleeve bottom edge (480), and either the sleeve first edge (490), or the sleeve second edge (500) are sealed.

In some embodiments, the system (100) comprises a display unit (600) having a display unit front surface (610) and a display unit back surface (620). In some embodiments, the display unit front surface (610) is designed to receive the protective sleeve (400) located thereon via only the first attaching means (560) located on the sleeve back surface (440). In some embodiments, a second attaching means (630) located on the display unit front surface (610) and is adapted to connect to and receive the first attaching means (560). In some embodiments, the display unit back surface (620) comprises a display unit mounting component (640) located thereon.

In some embodiments, the first attaching means (560), and the second attaching means (630) are a hook and loop system, an adhesive system, a magnet system, a snap system, a hook system, or a button system. In some embodiments, the first attaching means (560) may be located in any location on the sleeve back surface (440), for example, a corner, a side edge, or anywhere in a middle area. In some embodiments, a plurality of first attaching means (560) may be located in any location on the sleeve back surface (440).

In some embodiments, the second attaching means (630) may be located in any location on the display unit front surface (610), for example, a corner, a side edge, or anywhere in a middle area. In some embodiments, a plurality of second attaching means (630) may be located in any location on the display unit front surface (610).

As used herein, the term "about" refers to plus or minus 10% of the referenced number.

The disclosures of the following U.S. Patents are incorporated in their entirety by reference herein: U.S. Pat. No. 253,356; U.S. Pat. No. 3,696,532; U.S. Pat. No. 4,620,630; U.S. Pat. No. 6,696,532; and U.S. Pat. No. 7,418,796.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A greeting card display system (100) for preserving and displaying a greeting card (200), wherein said system (100) comprises:

(a) a greeting card (200) having at least a card first panel (210) and a card second panel (220), wherein the greeting card (200) comprises a card front surface (230) disposed on a card first panel (210), a card back surface (240) disposed on a card second panel (220), a card first inside surface (250) disposed on the card first panel (210) opposed to the card front surface (230), a card second inside surface (260) disposed on the card second panel (220) opposed to the card back surface (240), a card top edge (270) disposed on the card first panel (210) and the card second panel (220), a card bottom edge (280) disposed on the card first panel (210) and the card second panel (220) opposed to the card top edge (270), a card first edge (290) disposed on the card first panel (210), a card second edge (300) disposed on the card second panel (220), and a card first crease (310) disposed from the card top edge (270) to the card bottom edge (280), wherein the card first panel (210) is pivotally disposed on the card second panel (220) via the card first crease (310), wherein the card first crease (310) divides the card front surface (230) from the card back surface (240) and the card first inside surface (250) from the card second inside surface (260), wherein in a first open position, the card first inside surface (250) is pivoted away from the card second inside surface (260), wherein in a second closed position, the card first inside surface (250) is pivoted interfacingly against the card second inside surface (260); and (b) a protective sleeve (400) having at least a sleeve first panel (410) and a sleeve second panel (420), wherein the protective sleeve (400) comprises a sleeve front surface (430) disposed on a sleeve first panel (410), a sleeve back surface (440) disposed on a sleeve second panel (420), a sleeve first inside surface (450) disposed on the sleeve first panel (410) opposed to the sleeve front surface (430), a sleeve second inside surface (460) disposed on the sleeve second panel (420) opposed to the sleeve back surface (440), a sleeve top edge (470) disposed on the sleeve first panel (410) and the sleeve second panel (420), a sleeve bottom edge (480) disposed on the sleeve first panel (410) and the sleeve second panel (420) opposed to the sleeve top edge (470), a sleeve first edge (490) disposed on the sleeve first panel (410), a sleeve second edge (500) disposed on the sleeve second panel (420), a sleeve first inside crease (510) disposed from the sleeve top edge (470) to the sleeve bottom edge (480), and a sleeve first outside crease (520) disposed from the sleeve top edge (470) to the sleeve bottom edge (480), wherein the protective sleeve (400) comprises a sleeve cavity (530) disposed therein from the sleeve top edge (470) to the sleeve bottom edge (480) and the sleeve first edge (490) to the sleeve second edge (500), wherein the sleeve cavity (530) passes through and is not divided by the sleeve first inside crease (510) and the sleeve first outside crease (520), wherein the protective sleeve (400) comprises a single sleeve opening (540) fluidly connected to the sleeve cavity (530) disposed on the sleeve top edge (470), the sleeve bottom edge (480), the sleeve first edge (490), or the sleeve second edge (500), wherein the single sleeve opening (540) is adapted for insertion of the greeting card (200), wherein the protective sleeve (400) comprises at least three sealed edges disposed on any combination of the sleeve top edge (470), the sleeve bottom edge (480), the sleeve first edge (490), or the sleeve second edge (500), wherein the sleeve first panel (410) is pivotally disposed on the sleeve second panel (420) via the sleeve first inside crease (510) and the sleeve first outside crease (520), wherein the sleeve first outside crease (520) divides the sleeve front surface (430) from the sleeve back surface (440) and the sleeve first inside crease (510) divides the sleeve first inside surface (450) from the sleeve second inside surface (460), wherein the sleeve first inside crease (510) and the sleeve first outside crease (520) each lay on a plane, Plane A (550), wherein in a first open position, the sleeve first inside surface (450) is pivoted away from the sleeve second inside surface (460), wherein in a second closed position, the sleeve first inside surface (450) is pivoted interfacingly against the sleeve second inside surface (460), wherein the protective sleeve (400) comprise a general shape of an envelope, wherein the sleeve front surface (430), the sleeve first inside surface (450), and the sleeve second inside surface (460) are transparent, semi-transparent or translucent, wherein the sleeve back surface (440) comprises a first attaching means (560);

wherein the protective sleeve (400) is moved into the first open position, wherein the greeting card (200) is inserted into the sleeve cavity (530) of the protective sleeve (400) via the sleeve opening (540), wherein the protective sleeve (400) is moved into the second closed position, wherein the protective sleeve (400) is designed to be disposed on a display unit (600) via the first attaching means (560).

2. The system (100) of claim 1, wherein the system (100) further comprises the display unit (600) having a display unit front surface (610) and a display unit back surface (620), wherein the display unit front surface (610) is adapted to receive the protective sleeve (400) disposed thereon via a second attaching means (630), wherein the second attaching means (630) adapted to connectably receive the first attaching means (560), wherein the display unit back surface (620) comprises a display unit mounting component (640) disposed thereon.

3. The system (100) of claim 1, wherein the greeting card (200) comprises a card third panel (700) having a card third panel first edge (710) pivotally disposed on the card second edge (300).

4. The system (100) of claim 3, wherein the protective sleeve (400) comprises a sleeve third panel (720) having a sleeve third panel first inside edge (730) pivotally disposed on the sleeve front surface of the sleeve second edge (500) and the sleeve third panel first outside edge (740) pivotally disposed on the sleeve back surface of the sleeve second edge (500).

5. The system (100) of claim 1, wherein the card first panel (210) comprises a decorative component (750) disposed thereon having a thickness, wherein the card first panel (210) comprises a thickness between 0 inches and ½ inches at a thickest point between the card front surface (230) having the decorative component (750) disposed thereon and the card first inside surface (250).

6. The system (100) of claim 5, wherein the protective sleeve (400) comprises a sleeve first edge panel (760), a sleeve second edge panel (770) and a sleeve third edge panel (780), wherein the sleeve first edge panel (760), a sleeve second edge panel (770) and a sleeve third edge panel (780) each comprise a width adapted to accommodate the first panel comprising a decorating component disposed thereon, wherein the sleeve first edge panel (760) is disposed at the sleeve first edge (490) having edges fluidly connecting the sleeve front surface (430) to the sleeve back surface (440), wherein the sleeve second edge panel (770) is disposed at the sleeve bottom edge (480) or the sleeve top edge (470) having edges fluidly connecting the sleeve front surface (430) to the sleeve back surface (440), wherein the sleeve third edge panel (780) is disposed at the sleeve second edge (500) having edges fluidly connecting the sleeve front surface (430) to the sleeve back surface (440).

7. The system (100) of claim 1, wherein the single sleeve opening (540) comprises a sealing means (790) disposed thereon.

8. The system (100) of claim 7, wherein the sealing means (790) is reopenable and resealable.

9. The system (100) of claim 1, wherein a sleeve cavity inside surface (800) comprises a non-stick coating disposed thereon.

10. The system (100) of claim 1, wherein the protective sleeve (400) comprises a decorative component (750) disposed on a sleeve front surface (430) thereon.

11. The system (100) of claim 1, wherein the sleeve first panel (410) and the sleeve second panel (420) are bendable and are constructed from a bendable material.

12. The system (100) of claim 1, wherein the sleeve first panel (410) and the sleeve second panel (420) are rigid and are constructed from a rigid material.

13. The system (100) of claim 1, wherein the protective sleeve (400) is constructed from a material that comprises an ultra-violet radiation protection component.

14. The system (100) of claim 1, wherein the protective sleeve (400) is constructed from a material that is polarized.

15. The system (100) of claim 1, wherein the protective sleeve (400) comprises a magnification component (810) disposed on a sleeve front surface (430), a sleeve first inside surface (450), a sleeve second inside surface (460), or any combination thereof.

16. The system (100) of claim 1, wherein the sleeve first edge (490), the sleeve second edge (500), and the sleeve bottom edge (480) are sealed.

17. The system (100) of claim 1, wherein the sleeve top edge (470), the sleeve bottom edge (480), and either the sleeve first edge (490), or the sleeve second edge (500) are sealed.

* * * * *